US010587071B2

(12) United States Patent
Masui et al.

(10) Patent No.: US 10,587,071 B2
(45) Date of Patent: Mar. 10, 2020

(54) ELASTIC SEAL MEMBER AND CONNECTOR

(71) Applicant: Yazaki Corporation, Tokyo (JP)

(72) Inventors: Yukari Masui, Makinohara (JP); Tooru Kobayashi, Makinohara (JP)

(73) Assignee: YAZAKI CORPORATION, Minato-ku, Tokyo (JP)

( * ) Notice: Subject to any disclaimer, the term of this patent is extended or adjusted under 35 U.S.C. 154(b) by 0 days.

(21) Appl. No.: 15/970,256

(22) Filed: May 3, 2018

(65) Prior Publication Data

US 2018/0248303 A1 Aug. 30, 2018

Related U.S. Application Data

(63) Continuation of application No. PCT/JP2016/085790, filed on Dec. 1, 2016.

(30) Foreign Application Priority Data

Dec. 2, 2015 (JP) ..... 2015-235811

(51) Int. Cl.
*H01R 13/52* (2006.01)
*H01R 9/03* (2006.01)
(Continued)

(52) U.S. Cl.
CPC ..... *H01R 13/5208* (2013.01); *H01R 9/03* (2013.01); *H01R 13/40* (2013.01); *H01R 13/64* (2013.01); *H01R 13/62938* (2013.01)

(58) Field of Classification Search
CPC .... H01R 13/5208; H01R 13/40; H01R 13/64; H01R 13/62938; H01R 9/03
(Continued)

(56) References Cited

U.S. PATENT DOCUMENTS 5,299,949 A * 4/1994 Fortin ..... H01R 13/5205 439/275
6,036,541 A * 3/2000 Koumatsu ..... F16J 15/062 215/355
(Continued)

FOREIGN PATENT DOCUMENTS

EP 1059698 A2 12/2000
EP 1204174 A1 5/2002
(Continued)

OTHER PUBLICATIONS

International Search Report of PCT/JP2016/085790 filed Jan. 31, 2017.
(Continued)

*Primary Examiner* — Harshad C Patel
(74) *Attorney, Agent, or Firm* — Sughrue Mion, PLLC

(57) ABSTRACT

Provided is an elastic seal member and a connector which can suppress deterioration of a sealing property while suppressing an insertion resistance to a wire insertion hole. A plurality of seal insertion holes (electric wire insertion holes) through which terminal-equipped electric wires are inserted in the thickness direction is arranged and provided, and on at least one of the front and back surfaces a thinned groove is provided adjacent to the seal insertion hole (electric wire insertion hole), and the thinned groove is formed into a shape that does not overlap with a circular range centered on the seal insertion hole (electric wire insertion hole) in a plan view when viewing the one surface, the circular range of the electric wire insertion holes (electric wire insertion hole) adjacent to each other interposing the thinned groove being not overlapping with each other.

10 Claims, 6 Drawing Sheets

(51) Int. Cl.
*H01R 13/40* (2006.01)
*H01R 13/64* (2006.01)
*H01R 13/629* (2006.01)

(58) Field of Classification Search
USPC ..... 439/587, 271–282
See application file for complete search history.

(56) References Cited

U.S. PATENT DOCUMENTS 6,383,022 B1 * 5/2002 Murakami ..... H01R 13/5208 439/274
6,554,631 B2 * 4/2003 Ishikawa ..... H01R 13/5208 439/274
7,114,991 B2 * 10/2006 Shiga ..... H01R 13/5208 439/587
7,156,698 B2 * 1/2007 Yamashita ..... H01R 13/5208 439/587
7,273,395 B2 * 9/2007 Hayashi ..... H01R 13/506 439/587
7,371,115 B1 * 5/2008 Hsieh ..... H01R 13/5208 439/271
8,267,720 B2 * 9/2012 Ishida ..... H01R 13/5208 439/587
8,545,263 B2 * 10/2013 Islam ..... H01R 9/0521 439/578
8,545,264 B2 * 10/2013 Nawa ..... H01R 13/5208 439/274
8,568,168 B2 * 10/2013 Han ..... B29C 45/2628 439/587
9,178,301 B2 * 11/2015 Shiga ..... H01R 13/5208
2002/0127912 A1 * 9/2002 Hamai ..... H01R 13/5208 439/587
2011/0111627 A1 * 5/2011 Sawamura ..... H01R 13/5208 439/587
2011/0117780 A1 5/2011 Ishida

FOREIGN PATENT DOCUMENTS

JP 09-180810 A 7/1997
JP 2006-140019 A 6/2006
JP 2008-166045 A 7/2008
JP 2010-27231 A 2/2010
JP 2015-032560 A 2/2015

OTHER PUBLICATIONS

Japanese Office Action corresponding to JP application No. 2015-235811 filed Dec. 26, 2017.
Communication dated Oct. 18, 2018 from the European Patent Office in counterpart application No. 16870794.1.

* cited by examiner

PRIOR ART

ELASTIC SEAL MEMBER AND CONNECTOR

BACKGROUND OF THE INVENTION

Field of the Invention

The present invention relates to an elastic seal member attached to a connector provided in a terminal of a wire harness, and a connector including such elastic seal member.

Description of the Related Art

A variety of electronic devices are mounted on a vehicle as a mobile body. These electronic devices are connected with wire harnesses for transmitting power, control signals and the like between each other. The wire harness includes a wire bundle in which a plurality of electric wires are bundled and a connector to be attached to a terminal of the electric wire bundle. As such a connector, there is known a connector including a housing accommodating a plurality of terminal-equipped electric wires and an elastic seal member provided inside the housing to prevent water from entering from outside (for example, see Patent Document 1. As such an elastic seal member, there are many cases in which a form of a plate made of elastic material such as silicone rubber is fitted into an opening of the housing, as well as an electric wire insertion hole through which a terminal-equipped wire is inserted is provided. FIG. 8 shows an example of a conventional elastic seal member.

The elastic seal member 510 shown in FIG. 8 is formed of elastic material in the form of a plate, and a plurality of wire insertion holes 511 through which the terminal-equipped electric wire 520 is inserted in the insertion direction along the thickness direction is arranged.

Patent Document

Japanese Unexamined Patent Application Publication No. 2010-27231

SUMMARY OF THE INVENTION

Here, in the conventional elastic seal member 510 shown in FIG. 8, the electric wire insertion hole 511 is expanded by inserting the terminal-equipped electric wire 520 in the electric wire insertion hole 511. As a result, the other wire insertion holes 511 positioned next to the diameter-increased wire insertion holes 511 are distorted. If the degree of this distortion is too large, the insertion resistance of the terminal-equipped wire 520 to the distorted electric wire insertion hole 511 is large and it is sometimes difficult to insert it. If the wire insertion hole 511 is formed to be large in anticipation of such distortion, the contact pressure between the inner surface of the wire insertion hole 511 and the terminal-equipped wire 520 decreases, which may lower the sealing performance.

Therefore, paying attention to the above problems, an object of the present invention is to provide an elastic seal member and a connector capable of suppressing deterioration of the sealing property while suppressing the insertion resistance to the wire insertion hole.

In order to solve the above-mentioned problems, the elastic seal member of the present invention is formed of an elastic material in a plate shape and fitted into an opening on one end side of a tubular connector housing, the elastic seal member includes a plurality of electric wire insertion holes arranged through which an terminal-equipped electric wire is inserted in a thickness direction, and a thinned groove is provided adjacent to the electric wire insertion hole on at least one of the front and back surfaces of the plate shape, wherein the thinned groove is formed into a shape that does not overlap with a circular range centered on the electric wire insertion hole in a plan view when viewing the one surface, and the circular range of the electric wire insertion holes adjacent to each other interposing the thinned groove being not overlapping with each other.

According to the elastic seal member of the present invention, by inserting the terminal-equipped wire through the wire insertion hole, even if the wire insertion hole expands in diameter, contraction of the thinned groove provided adjacent to the wire insertion hole makes distortion of the electric wire insertion hole adjacent to the electric wire insertion hole through which the electric wire has been inserted suppressed. Thereby, the insertion resistance to the wire insertion hole is suppressed. At this time, the thinned groove is formed into the shape that does not overlap with the circular range centered on the electric wire insertion hole, and the circular range of the electric wire insertion holes adjacent to each other interposing the thinned groove being not overlapping with each other. As a result, a certain thickness is secured around the wire insertion hole, so that decrease in the contact pressure between the inner surface of the wire insertion hole and the terminal-equipped wire is suppressed and the deterioration of the sealing property is suppressed. Thus, according to the elastic seal member of the present invention, it is possible to suppress deterioration of the sealing property while suppressing insertion resistance to the wire insertion hole.

In the elastic seal member according to the present invention, it is preferable that at least the part of the outside edge thereof located between the electric wire insertion holes in the plan view is coincident with an outer circumference of the circular range corresponding to each of the electric wire insertion holes adjacent to each other across the thinned groove.

According to this preferable elastic sealing member, as described above, the deterioration of the sealing property is suppressed and the thinned groove is formed to have a sufficient size in the above-described plan view, and as a result, the resistance to insertion to the electric wire insertion holes is further suppressed.

Further, in the elastic seal member of the present invention, it is preferable that the plurality of the electric wire insertion holes is arranged at a first interval in a first direction in the plan view, and a second gap is arrayed at a second interval larger than the first interval in a second direction intersecting the first direction, and wherein the thinned groove is provided adjacent to the electric wire insertion hole in the second direction.

According to this preferable elastic seal member, the thinned groove is provided adjacent to the electric wire insertion hole in the second direction in which the arrangement interval of the electric wire insertion holes is relatively wide. In other words, by providing the thinned groove at a place where there is plenty of space, a constant thickness is ensured in a wider area around the electric wire insertion hole, so that it is possible to further suppress deterioration of the sealing property.

Further, in the elastic seal member according to the present invention, it is preferable that the inner circumferential surface of the electric wire insertion hole is provided with a lip ring by four rows or more, protruding over an entire circumference so as to be in close contact with an outer circumferential surface of an electric wire portion of the terminal-equipped electric wire inserted through the electric wire insertion hole in a thickness direction, and the thinned groove is formed mutually from both front and back surfaces in the plate shape and an excess portion corresponding to at least two rows of the lip ring is left between the plate shape in the thickness direction of the plate shape.

According to this preferred elastic seal member, by providing the thinned grooves on both the front and back surfaces of the elastic seal member, the insertion resistance of the terminal-equipped electric wire can be further suppressed. Then, the excess portion corresponding to two rows of lip rings is left between the thinned grooves on the front and back surfaces, so that the contact pressure after insertion between the terminal-equipped wire and the inner surface of the electric wire insertion hole is suppressed, so that it is possible to further suppress deterioration of the sealing property.

Further, in the elastic seal member of the present invention, it is preferable that the electric wire insertion hole has a small diameter portion having a relatively small inner diameter and a large diameter portion having a relatively large inner diameter, two adjacent electric wire insertion holes without holding the thinned groove are provided so that a predetermined distance is separated between the respective large diameter portions, the circular range is a circular range having a diameter equal to or larger than the length obtained by adding the two predetermined distances to the inner diameter of the large diameter portion.

According to this preferable elastic seal member, a thickness corresponding to at least the predetermined distance over the entire circumference, including the direction of the thinned groove, is formed around the large diameter portion which tends to be thin in wall thickness is secured. As a result, the reduction in the contact pressure between the terminal-equipped wire and the inner surface of the wire insertion hole after insertion can be suppressed, so that it is possible to further suppress deterioration of the sealing property.

In order to solve the above-mentioned problems, the connector of the present invention is a connector including a tubular connector housing and an elastic seal member fitted into an opening on one end side of the connector housing, wherein the elastic seal member is the elastic seal member of the present invention described above.

According to the connector of the present invention, since the elastic seal member is the above-described elastic seal member of the present invention, it is possible to suppress deterioration of the sealing property while suppressing insertion resistance to the wire insertion hole.

According to the present invention, it is possible to suppress deterioration of the sealing property while suppressing insertion resistance to the wire insertion hole.

DETAILED DESCRIPTION OF THE PREFERRED EMBODIMENT

An elastic seal member according to an embodiment of the present invention will be described with reference to FIGS. 1 to 7B.

Figure 1:
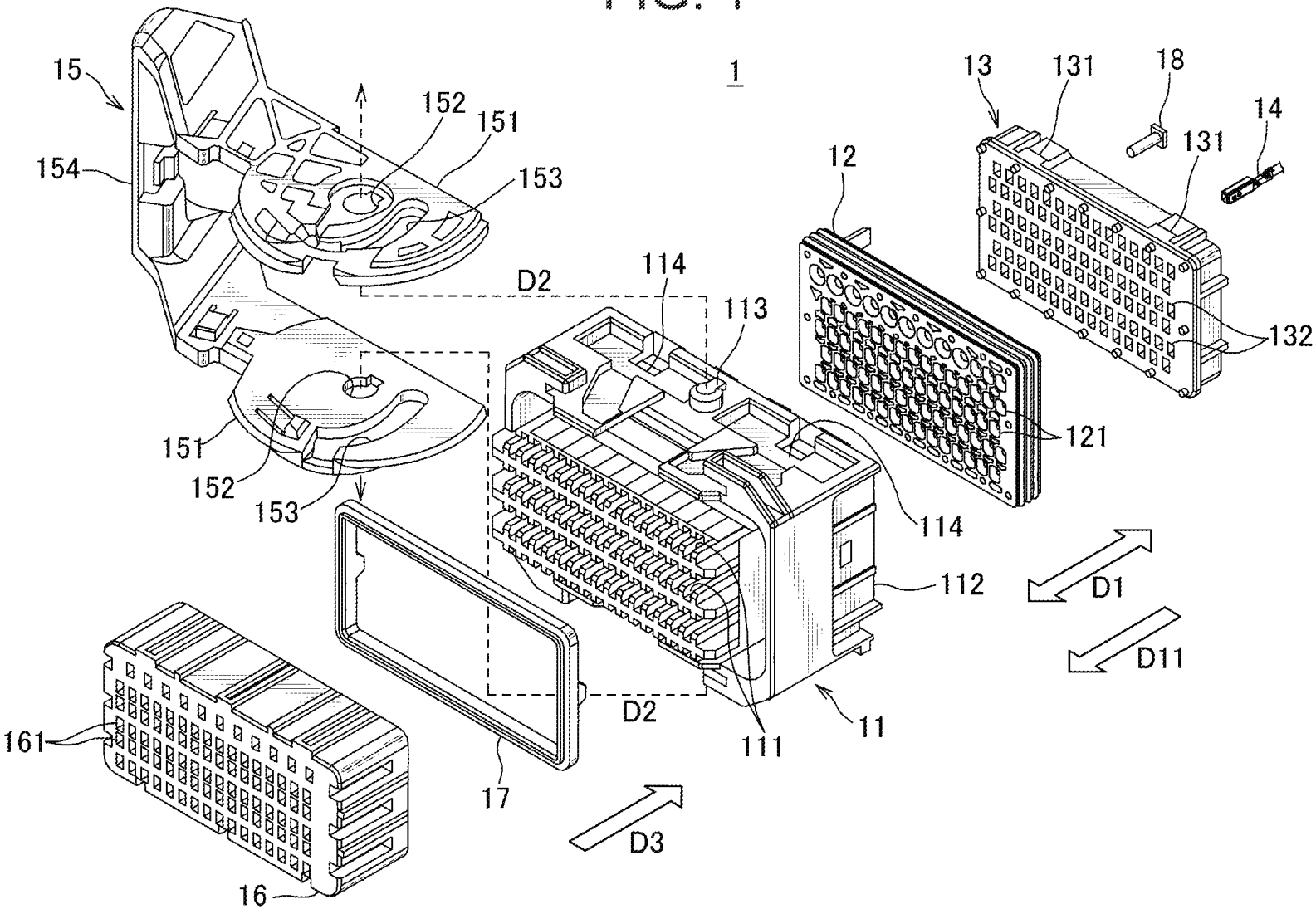
FIG. 1 is an exploded perspective view showing a connector according to an embodiment of the present invention.
Figure 2:
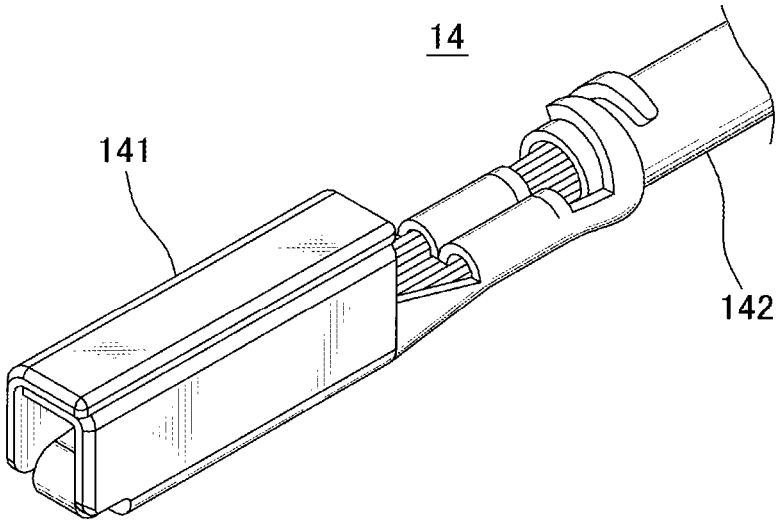
FIG. 2 is a view showing a wire with a terminal shown in FIG. 1.

First, the overall configuration of a connector according to one embodiment of the present invention will be described. FIG. 1 is an exploded perspective view showing a connector according to an embodiment of the present invention. FIG. 2 is a view showing a wire with a terminal shown in FIG. 1.

The connector 1 shown in FIG. 1 is a lever fitting type connector which engages with a mating connector (not shown) by pivoting of the fitting lever 15. The connector 1 includes a connector housing 11, an elastic seal member 12, a rear grid 13, a terminal-equipped wire 14, a fitting lever 15, a terminal position assurance (TPA) member 16, a packing 17, and a dummy plug 18. Here, in the connector 1, a side on which an electric wire portion 142 of the terminal-equipped electric wire 14 shown in FIG. 2 extends is referred to as a rear side, and the opposite side thereof is referred to as a front side on which a mating connector (not shown) is fitted.

The connector housing 11 is formed in a tubular shape, and a plurality of terminal accommodating chambers 111 in which the terminals 141 of the terminal-equipped electric wires 14 are accommodated is provided inside the connector housing 11.

In each of the plurality of terminal accommodating chambers 111, the terminals 141 of the terminal-equipped electric wires 14 are inserted and housed one by one in the insertion direction D11 along the thickness direction D1 of the elastic seal member 12 indicated by an arrow in the drawing. A part of the plurality of terminal accommodating chambers 111 is exposed to the front side, and the TPA member 16 is put on the plurality of terminal accommodating chambers 111.

The rear side of the connector housing 11 is an opening 112 from which the elastic seal member 12 is fitted in the insertion direction D11 and the rear grid 13 is fitted in the insertion direction D11 while the elastic seal member 12 is pushed toward the terminal receiving chamber 111 side.

A rotational shaft 113 of the fitting lever 15 is provided protruding on the outer wall of the connector housing 11.

The elastic seal member 12 is formed in a plate shape with an elastic material such as silicone rubber and fitted into the opening 112 of the connector housing 11 as described above. A plurality of seal insertion holes 121 (electric wire insertion holes) is provided through which the terminal-equipped electric wires 14 are inserted in the insertion direction D11 along the thickness direction D1 of the elastic seal member 12. Each of the seal insertion holes 121 communicates with each terminal accommodation chamber 111 when fitted into the opening 112 of the connector housing 11. The elastic seal member 12 will be described later in detail.

The rear grid 13 is fitted into the opening 112 of the connector housing 11 as described above. On the outer peripheral surface of the rear grid 13, as shown in FIG. 1, an engaging claw 131 is provided. The engaging claw 131 is engaged with a locking hole 114 provided on the outer wall of the connector housing 11 so that the rear grid 13 is fixed to the connector housing 11 in a state where the elastic sealing member 12 is pressed as described above. The rear grid 13 is provided with a plurality of grid insertion holes 132 communicating with the above-described seal insertion hole 121.

The terminal-equipped wire 14 is composed of a terminal 141 and an electric wire portion 142 as shown in FIG. 2. In the present embodiment, the connector housing 11 accommodates two types of terminal-equipped electric wires having different sizes. Two types of terminal-equipped wires have the same structure except for their sizes. Therefore, in the following description, the two kinds of terminal-equipped wires will be described simply by referring to the terminal-equipped electric wire 14 without distinction unless otherwise noted. In FIG. 1, only one terminal-equipped wire 14 is representatively shown. The terminal 141 of the terminal-equipped wire 14 is a rectangular tubular female terminal and is connected to the male terminal of the mating connector. The terminal-equipped wire 14 is inserted through the grid insertion hole 132 and the seal insertion hole 121 in the insertion direction D11, and the terminal 141 is accommodated in the terminal receiving chamber 111.

The fitting lever 15 is a member formed in a substantially C shape so as to sandwich the connector housing 11 in the vertical direction in FIG. 1. Each of the upper and lower two arm portions 151 is provided with a bearing hole 152 into which the rotating shaft 113 protruding from the outer wall of the connector housing 11 is fitted. As shown by an arrow D2 in FIG. 1, the rotation shaft 113 is fitted into the bearing hole 152, whereby the fitting lever 15 is rotatably fixed to the connector housing 11. In addition, each arm portion 151 is provided with a guide groove 153 which is engaged with the mating connector and guides it in the direction of attracting to the connector 1 of this embodiment. A portion connecting the two arm portions 151 is an operation portion 154 operated by an operator. In a state where the guide groove 153 is engaged with the mating connector, the operator operates the operation portion 154 to rotate the fitting lever 15, whereby the mating connector is attracted to the connector 1 of the present embodiment so that both are engaged.

On the front side of the connector housing 11, the TPA member 16 is attached in the direction of the arrow D3 with the packing 17 interposed therebetween.

The TPA member 16 is a cap-like member that covers the plurality of terminal accommodating chambers 111 exposed to the front side, and serves to hold the terminals 141 so as not to move within the respective terminal accommodating chambers 111. The packing 17 is a member that plays a role of waterproofing by blocking the gap between the TPA member 16 and the connector housing 11. The TPA member 16 is provided with a plurality of terminal entrance holes 161 communicating with the terminal accommodating chambers 111 of the connector housing 11 and into which the terminals of the mating connector enter.

The dummy plug 18 is a resin-made pin that closes the grid insertion hole 132 or the seal insertion hole 121 leading to the unused terminal receiving chamber 111 where the terminal-equipped wire 14 is not inserted. The dummy plug 18 prevents water from entering through the grid insertion hole 132 or the seal insertion hole 121. Though not shown, this dummy plug 18 is also provided with two kinds of large size and small size.

Figure 3:
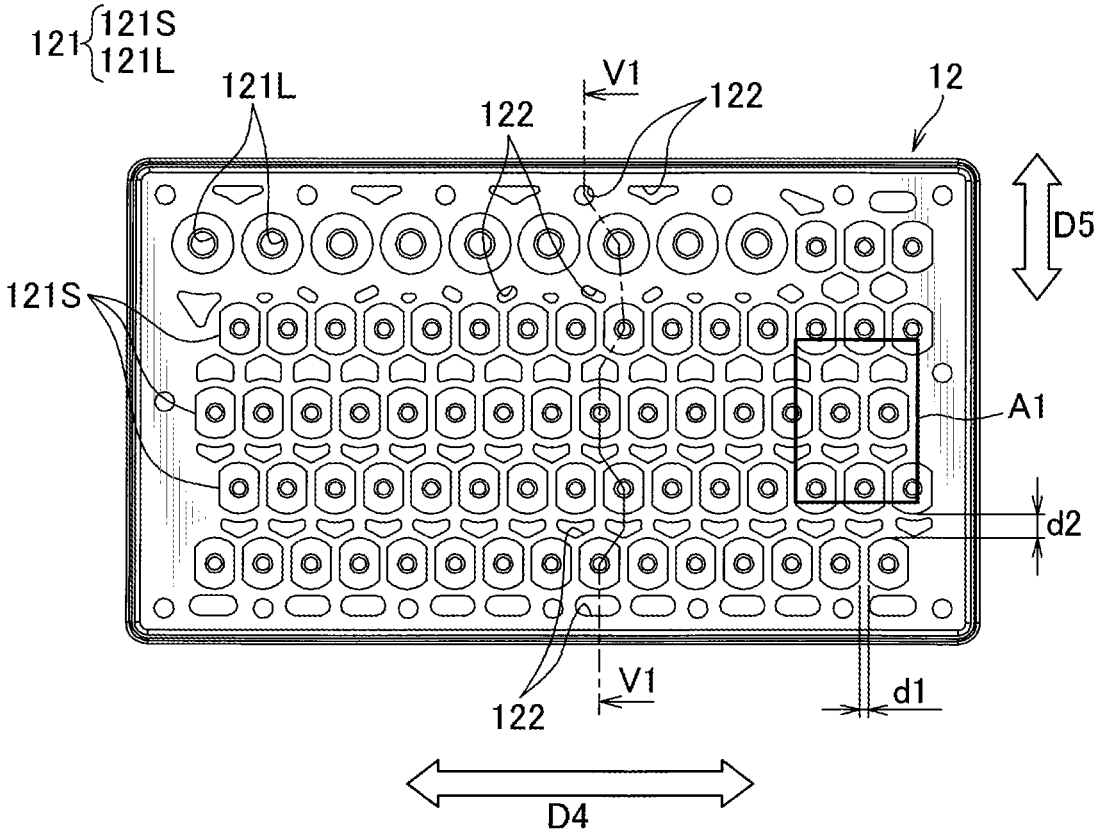
FIG. 3 is a plan view showing a surface of the elastic seal member according to one embodiment of the present invention as seen from the front side of the connector shown in FIG. 1.
Figure 4:
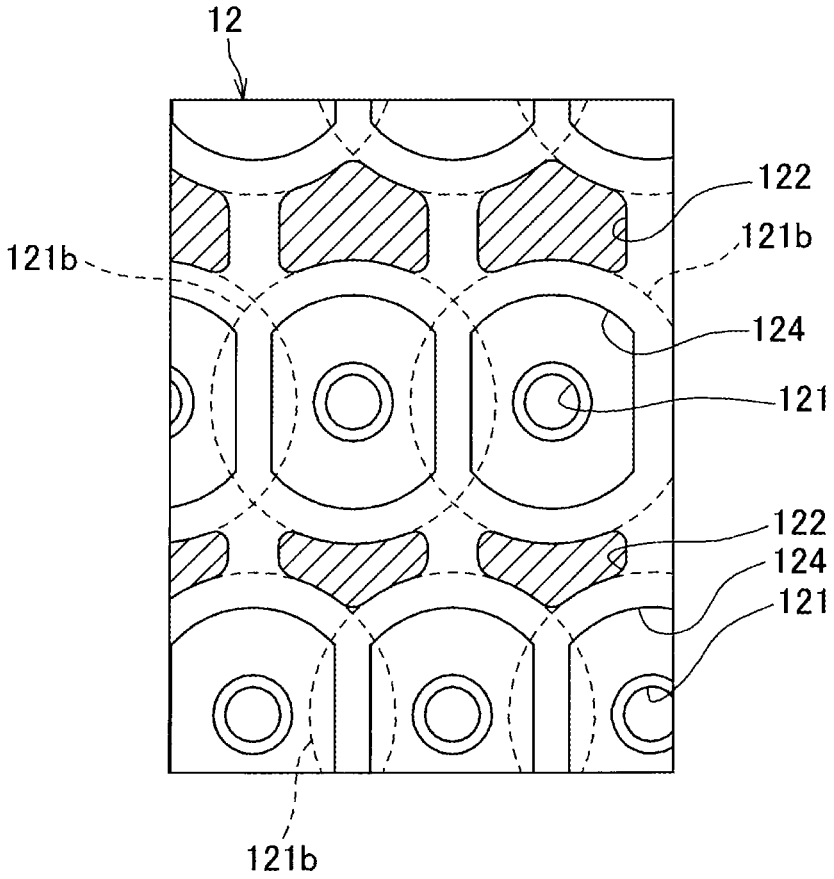
FIG. 4 is an enlarged view of a range A1 in FIG. 3.
Figure 5:
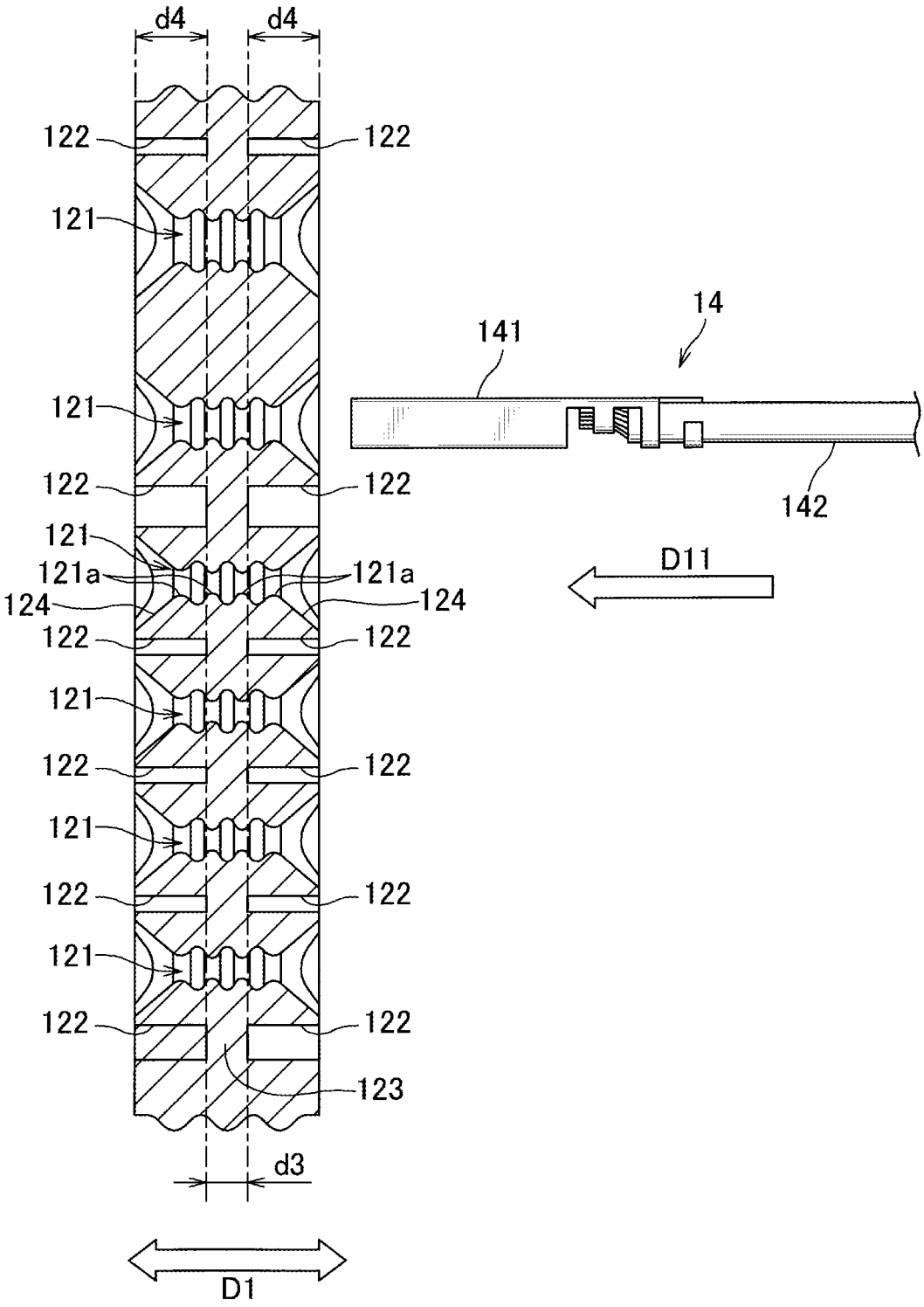
FIG. 5 is a cross-sectional view of the elastic seal member shown in FIG. 3, taken along a line V1-V1 in FIG. 3.

Next, the elastic seal member 12 according to one embodiment of the present invention will be described in detail with reference to FIGS. 3 to 7. FIG. 3 is a plan view showing a surface of the elastic seal member according to one embodiment of the present invention as seen from the front side of the connector shown in FIG. 1. FIG. 4 is an enlarged view of a range A1 in FIG. 3, and FIG. 5 is a cross-sectional view of the elastic seal member shown in FIG. 3, taken along the line V1-V1 in FIG. 3. FIGS. 6A and 6B and FIGS. 7A and 7B will be referred to later.

The elastic seal member 12 is a member made of an elastic material such as silicone rubber and formed into a rectangular plate shape, and plays a role of preventing water from entering into the connector housing 11. The elastic seal member 12 is fitted through the opening 112 of the connector housing 11. In addition, the elastic seal member 12 is provided with a plurality of seal insertion holes 121 through which the terminal-equipped electric wire 14 is inserted in the insertion direction D11. The seal insertion hole 121 is composed of a small size seal insertion hole 121S through which a small size terminal-equipped wire 14 is inserted and a large size seal insertion hole 121L through which a large size terminal-equipped wire 14 is inserted. Incidentally, the small-size seal insertion hole 121S and the large-size seal insertion hole 121L have the same configuration except for their sizes. Therefore, in the following description, these two types of seal side insertion holes 121S and 121L will be simply described as a seal insertion hole 121 unless otherwise specified.

In the present embodiment, the inside of the seal insertion hole 121 has the structure shown in the cross-sectional view of FIG. 5. In FIG. 5, only one terminal-equipped electric wire 14 is representatively shown.

A plurality of seal insertion holes 121 is provided in the elastic seal member 12. Then, as shown in FIG. 5, on the inner circumferential surface of each seal insertion hole 121, a lip ring 121*a* is arranged in four rows in the direction D11 protruding over the entire circumference so as to be in close contact with the outer circumferential surface of the electric wire portion 142 of the terminal-equipped electric wire 14. When the terminal-equipped electric wire 14 is inserted, these lip rings 121*a* are brought into close contact with the outer peripheral surface of the electric wire portion 142, so that entry of water is prevented. Further, in the vicinity of the outlets at both ends of each of the seal insertion holes 121, there is provided an introducing portion 124 which serves as a funnel-shaped wide mouth and guides the insertion of the terminal-equipped electric wire 14 into the seal insertion hole 121.

As shown in FIGS. 3 to 5, the elastic seal member 12 is provided with a thinned groove 122 adjacent to the seal insertion hole 121 on both the front and back surfaces thereof. As shown in FIG. 4, this thinned groove 122 has a shape that does not overlap with such circular region 121*b* as seen in the plan view when viewing the surface where the thinned groove 122 is formed. The circular range 121*b* is a circular range centered on the seal insertion hole 121 where the seal insertion holes 121 adjacent to each other across the thinned groove 122 (adjacent in the oblique direction in the example of FIG. 4) do not overlap with each other. Further, in the present embodiment, at least a part of the outer edge of the thinned groove 122 located between the seal insertion holes 121 in plan view coincides with the outer periphery of the circular region 121*b*.

In addition, in the present embodiment, the circular range 121*b* has a range of the following size.

Figure 6B:
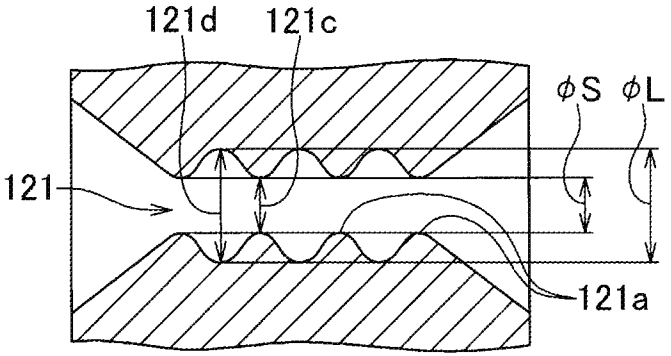
FIGS. 6A and 6B are schematic diagrams showing the size of the circular range shown in FIG. 4.
Figure 6A:
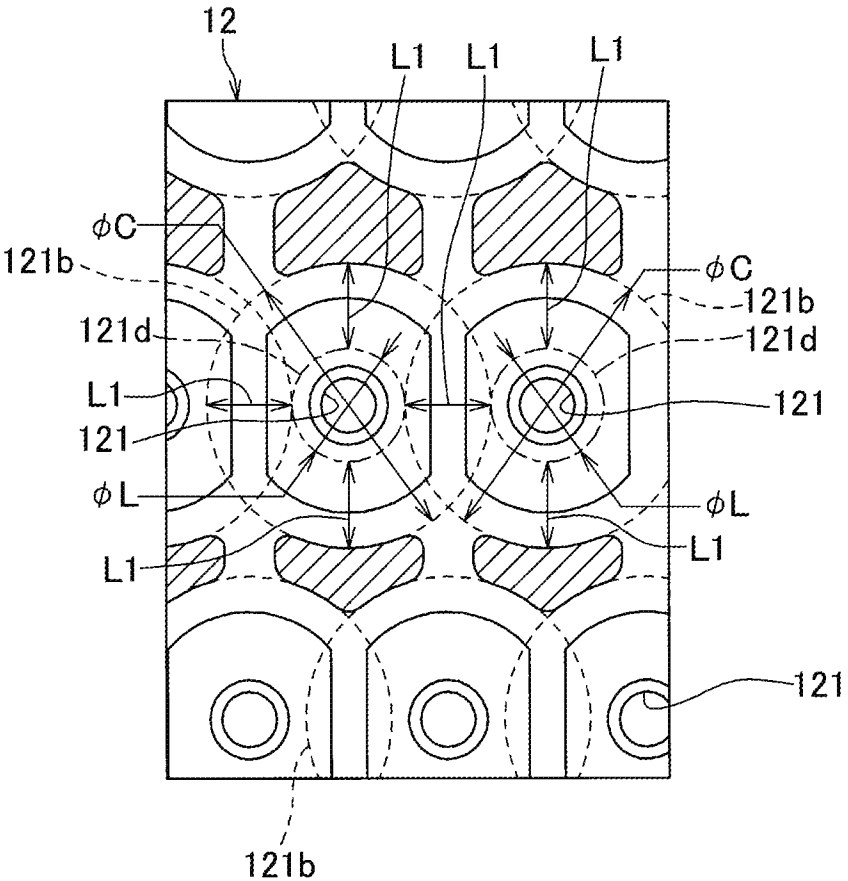

FIGS. 6A and 6B are schematic diagrams showing the size of the circular range shown in FIG. 4. FIG. 6A is a plan view similar to FIG. 4 and shows the size of the circular range 121*b*. FIG. 6B is a cross-sectional view of the seal insertion hole 121 for reference in FIG. 6A.

As described with reference to FIG. 5 and also shown in FIG. 6B, four rows of lip rings 121*a* are arranged in the insertion direction D11 on the inner peripheral surface of the seal insertion hole 121. Therefore, the seal insertion hole 121 has a small diameter portion 121*c* having a small diameter φS corresponding to the inner diameter of the lip ring 121*a* and of which the hole is narrowed, and a large diameter portion 121*d* having a large diameter φL corresponding to the inner diameter of the trough portion between the lip rings 121*a* and of which the hole is widened.

As shown in FIG. 6A, the two adjacent seal insertion holes 121 without sandwiching the thinned groove 122 are formed such that the respective large diameter portions 121*d* are spaced at a predetermined distance L1 therebetween. The above-described circular range 121*b* is a circular range having a diameter φC obtained by adding the above-described predetermined distance L1 as the mutual distance between the large diameter portions 121*d* to the large diameter φL in the seal insertion hole 121.

In the present embodiment, as an example of a circular range according to the present invention, the circular range 121*b* having a diameter φC obtained by adding the above-described predetermined distance L1 to the large diameter φL of the seal insertion hole 121 is exemplified. However, the circular range according to the present invention is not limited to this, but may be a circular range or the like having a slightly longer diameter than the above diameter φC for example.

Here, as shown in FIG. 4, the thinned groove 122 is provided in a shape that does not overlap with the guide portion 124 provided at the outlet of the seal insertion hole 121 in the plan view.

Here, in the elastic seal member 12, as shown in FIG. 3, the seal insertion holes 121 are arranged as follows in a plan view. That is, the seal insertion hole 121 is arranged with the first distance d1 in the long side direction D4 (first direction) of the elastic seal member 12, and is arranged in the short side direction D5 (second direction) crossing the long side direction D3 with a second interval d2 wider than the first interval d1. In the present embodiment, the thinned groove 122 is provided adjacent to the seal insertion hole 121 in the short side direction D5.

Further, in the present embodiment, the thinned grooves 122 provided on both the front and back surfaces of the elastic seal member 12 are provided at the central portion in the thickness direction D1 of the elastic seal member 12 with a depth d4 in which the excess thickness portion 123 of the thickness d3 corresponding to two rows of the above-described lip rings 121*a* is left.

According to the elastic seal member 12 of the embodiment described above and the connector 1 including the elastic seal member 12 thereof, the terminal-equipped electric wire 14 is inserted into the seal insertion hole 121 as follows.

Figure 7A:
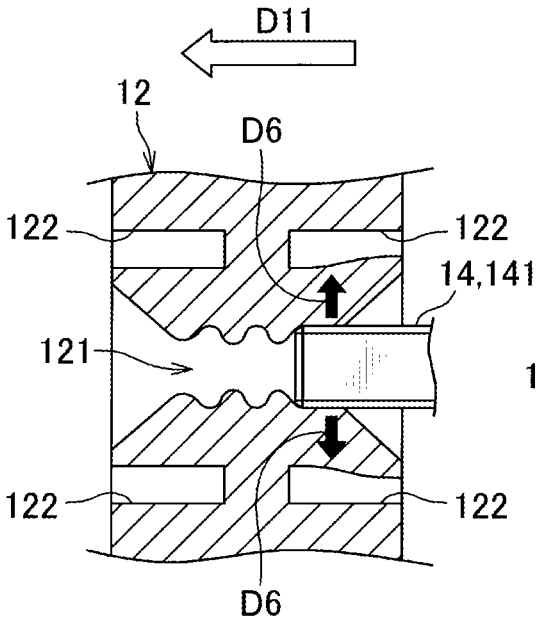
FIGS. 7A and 7B are views schematically showing a state where a terminal-equipped wire is inserted through a seal insertion hole of the elastic seal member shown in FIG. 3.
Figure 7B:
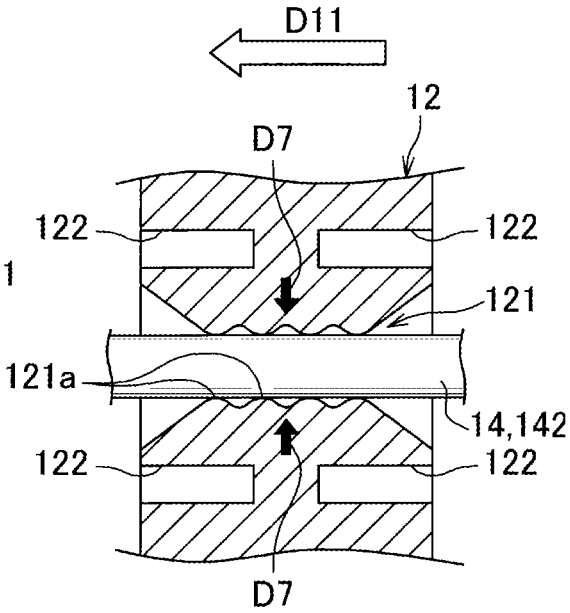
Figure 8:
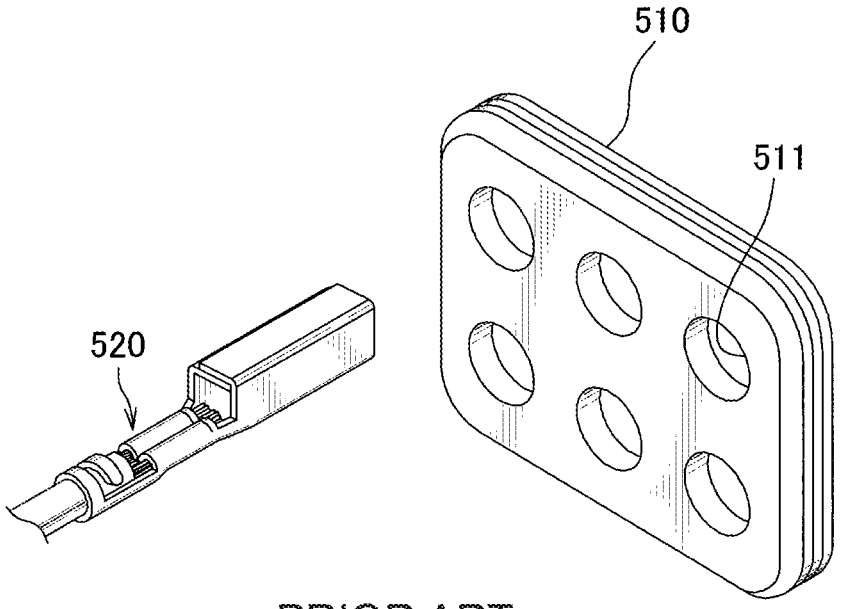
FIG. 8 is a diagram showing an example of a conventional elastic seal member.

FIGS. 7A and 7B are views schematically showing a state in which a terminal-equipped wire is inserted through the seal insertion hole of the elastic seal member shown in FIG. 3. FIG. 7A shows a state in which the terminal 141 of the terminal-equipped electric wire 14 enters the inside while pushing out the seal insertion hole 121 in the early stage of insertion. FIG. 7B shows that the terminal 141 passes through the seal insertion hole 121 and the electric wire portion 142 is located inside the seal insertion hole 121.

As shown in FIG. 7A, when the terminal 141 of the terminal-equipped wire 14 enters the seal insertion hole 121, the seal insertion hole 121 is expanded by the terminal 141. As a result, a pressure is generated as indicated by an arrow D6 that intersects the insertion direction D11 and goes to the outside of the seal insertion hole 121.

Further, after passing through the terminal 141, as shown in FIG. 7B, a pressure indicated by an arrow D7 causing the lip ring 121*a* to be pressed against the electric wire portion 142 is mainly generated. Also, at this time, the diameter of the seal insertion hole 121, although the degree is small compared to when passing through the terminal 141, is increased by the electric wire portion 142. As a result, a pressure is generated in the same direction as arrow D6 in FIG. 7A (that is, in the direction opposite to the direction of arrow D7).

Here, the elastic seal member 12 of the present embodiment is provided with a thinned groove 122 adjacent to the seal insertion hole 121. Therefore, the pressure generated when passing through the terminal 141 is absorbed by the shrinkage of the thinned groove 122 as shown in FIG. 7A. As a result, the insertion resistance when passing through the terminal 141 is suppressed.

Similarly, the pressure generated in the state where the electric wire portion 142 is positioned inside the seal insertion hole 121 is also absorbed by the shrinkage of the thinned groove 122. Therefore, the terminal-equipped wire 14 is positioned next to the seal insertion hole 121 inserted, suppressing distortion of the seal insertion hole 121, through which the terminal-equipped wire 14 is not inserted. As a result, when the terminal-equipped wire 14 is inserted through the not-inserted seal insertion hole 121, the insertion pressure is absorbed by the thinned groove 122 as described above, and along with that, the insertion resistance is suppressed.

At this time, in the present embodiment, as shown in FIG. 4, the thinned groove 122 is formed in a shape not overlapping with the circular range 121*b* of the circular range centered on the seal insertion hole 121 and the circular range of the electric wire insertion holes 121 adjacent to each other interposing the thinned groove being not overlapping with each other. As a result, a certain thickness is secured around the seal insertion hole 121, so that a decrease in the contact pressure between the inner surface of the seal insertion hole 121 and the terminal-equipped electric wire 14 is suppressed and the deterioration of the sealing property is suppressed. Thus, according to the elastic seal member 12 of the present embodiment, it is possible to suppress deterioration of the sealing property while suppressing insertion resistance to the seal insertion hole 121.

Further, in the elastic seal member 12 of the present embodiment, the thinned groove 122 is provided in a shape not overlapping with the guide portion 124 provided at the outlet of the seal insertion hole 121. As a result, a thicker wall thickness is secured around the seal insertion hole 121, further suppressing a decrease of the contact pressure between the inner surface of the seal insertion hole 121 and the terminal-equipped wire 14, so that a decrease in sealing property is further suppressed.

In the elastic seal member 12 of the present embodiment, at least a part of the outer edge of the thinned groove 122 positioned between the seal insertion holes 121 coincides with the outer periphery of the circular range 121*b* corresponding to each of the seal insertion holes 121 adjacent to and sandwiching the thinned groove 122. As a result, as described above, deterioration of the sealing property is suppressed, and formation of the thinned groove 122 having a sufficient size in the above-described plan view allows the insertion resistance to the seal insertion hole 121 to further be suppressed.

Further, in the elastic seal member 12 of the present embodiment, as shown in FIG. 3, a thinned groove 122 is provided adjacent to the seal insertion hole 121 in the short side direction D5 in which the arrangement interval is relatively wide. That is, by providing the thinned grooves 122 at places where there is plenty of space, a constant wall thickness is secured in a wider area around the seal insertion hole 121, thereby further suppressing deterioration of the sealing property.

Further, in the elastic seal member 12 of the present embodiment, four rows of lip rings 121*a* are provided on the inner peripheral surface of the seal insertion hole 121. Accordingly, by providing the thinned groove 122 on both the front and back surfaces of the elastic seal member 12, the insertion resistance of the terminal-equipped electric wire 14 can be further suppressed. Since the excess portion 123 corresponding to two rows of the lip rings 121*a* is left between the thinned grooves 122 on the front and back surfaces, the decrease of the contact pressure between the terminal-equipped electric wire 14 after insertion and the inner surface of the seal insertion hole 121 can be suppressed, thereby further suppressing deterioration of the sealing property.

In the elastic seal member 12 according to the present embodiment, as described with reference to FIGS. 6A and 6B, the circular range 121*b* ranges over the circle having the diameter φC where two above-mentioned predetermined distances L1 which is the mutual distance of the large diameter portion 121*d* is added to the inner diameter (large diameter φL) of the large diameter portion 121*d* of the seal insertion hole 121.

As described above, the thinned groove 122 is formed in the shape not overlapping with the circular range 121*b*. Therefore, by adopting the circular range 121*b* having the above-described size, the wall thickness corresponding to the predetermined distance L1 is secured over the circumference of the large-diameter portion 121*d* in the seal insertion hole 121, which tends to be thinner, including the direction of the thinned groove 122. As a result, the reduction in the contact pressure between the terminal-equipped wire 14 and the inner surface of the seal insertion hole 121 after insertion is suppressed, so that it is possible to further suppress deterioration of the sealing property.

It is to be noted that the above-described embodiment merely shows a representative form of the present invention, and the present invention is not limited to this embodiment. That is, various modifications can be made without departing from the gist of the present invention. Of course, as long as such deformation also has the configuration of the elastic seal member of the present invention, it is included in the scope of the present invention.

For example, in the above-described embodiment, as an example of the elastic seal member according to the present invention, in order to use two kinds of large and small terminal-equipped electric wires 14, the sealing member 12 is illustrated as an example in which the seal insertion hole 121 (electric wire insertion hole) is provided in two sizes. However, the elastic seal member referred to in the present invention is not limited to this. The elastic seal member referred to in the present invention may be, for example, a form in which using one type of terminal-equipped electric wire, the electric wire insertion holes corresponding to one size may be provided, or that in which using three or more kinds of terminal-equipped electric wires, three or more types of wire insertion holes may be provided corresponding to each size.

In the above-described embodiment, as an example of the lip ring according to the present invention, lip rings 121*a* arranged in four rows are exemplified. However, the lip ring according to the present invention is not limited to this, and the number of lip rings referred to in the present invention may be an arbitrary number such as four rows or five rows as long as it is four or more rows.

DESCRIPTION OF SYMBOLS

1 Connector
11 Connector housing
12 Elastic seal member
14 Terminal-equipped electric wire
112 Opening
121 Seal insertion hole (wire insertion hole)
121*a* Lip ring
121 *b* Circular range
121*c* Small diameter portion
121*d* Large diameter portion
122 Thinned groove
123 Excess portion
141 terminal
142 electric wire portion
D1 thickness direction
D2, D3 Arrow
D4 Long side direction (first direction)
D5 Short side direction (second direction)
D1 First interval
D2 Second interval
L1 predetermined distance
φS small diameter
φL large diameter
φC diameter

What is claimed is:

1. An elastic seal member formed of an elastic material in a plate shape and configured to be fitted into an opening on one end side of a tubular connector housing, the elastic seal member comprising;

a plurality of electric wire insertion holes arranged in a first direction and a second direction orthogonal to the first direction, the plurality of electric wire insertion holes being configured to have a terminal-equipped electric wire inserted therein in a thickness direction, and a plurality of thinned grooves provided adjacent to the plurality of electric wire insertion holes on at least one of front and back surfaces of the elastic seal member, wherein each of the plurality of thinned grooves is formed into a shape that does not overlap with any of each of a circular range centered on respective ones of the plurality of electric wire insertion holes in a plan view, the respective circular ranges of juxtaposed respective ones of the plurality of electric wire insertion holes interposing a thinned groove while not overlapping with each other, the plurality of the electric wire insertion holes being aligned in the first direction such that respective circular ranges adjacent electric wire insertion holes of the plurality of electric wire insertion holes overlap each other in the first direction, and being staggered in the second direction such that the plurality of thinned grooves is disposed between the plurality of electric wire insertion holes, at least two electric wire insertion holes of the plurality of electric wire insertion holes are provided adjacent to each other without having a thinned groove of the plurality of thinned grooved interposed therebetween, and the plurality of thinned grooves disposed between the plurality of electric wire insertion holes is formed in a plurality of types of shapes in the plan view.

2. The elastic seal member according to claim 1, wherein a thinned groove of the plurality of thinned grooves located between electric wire insertion holes of the plurality of electric wire insertion holes is formed so that at least a part of an outside edge thereof in the plan view is coincident with an outer circumference of the circular range corresponding to each of the adjacent respective ones of the plurality of electric wire insertion holes interposing the thinned groove.

3. The elastic seal member according to claim 2, wherein a lip ring is provided on an inner circumferential surface of one of the plurality of electric wire insertion holes by four rows or more in the thickness direction, the lip ring protruding over an entire circumference so as to be in close contact with an outer circumferential surface of an electric wire portion of the terminal-equipped electric wire inserted through the one of the plurality of electric wire insertion holes, and wherein a thinned groove of the plurality of thinned grooves is formed from both the front and back surfaces in the elastic seal member and an excess portion corresponding to at least two rows of the lip ring is left between the front surface and the back surface in the elastic seal member in the thickness direction.

4. The elastic seal member according to claim 3, wherein each of the plurality of electric wire insertion holes has a small diameter portion having a small inner diameter and a large diameter portion having a large inner diameter, the at least two electric wire insertion holes of the plurality of electric wire insertion holes which are provided adjacent to each other without having a thinned groove of the plurality of thinned grooved interposed therebetween are provided with a predetermined distance between their respective large diameter portions, and the circular range has a diameter equal to or larger than a length obtained by adding the predetermined distance to the inner diameter of a large diameter portion.

5. The elastic seal member according to claim 2, wherein each of the plurality of electric wire insertion holes has a small diameter portion having a small inner diameter and a large diameter portion having a large inner diameter, the at least two electric wire insertion holes of the plurality of electric wire insertion holes which are provided adjacent to each other without having a thinned groove of the plurality of thinned grooved interposed therebetween are provided with a predetermined distance between their respective large diameter portions, and the circular range has a diameter equal to or larger than a length obtained by adding the predetermined distance to the inner diameter of a large diameter portion.

6. The elastic seal member according to claim 1, wherein a lip ring is provided on an inner circumferential surface of one of the plurality of electric wire insertion holes by four rows or more in the thickness direction, the lip ring protruding over an entire circumference so as to be in close contact with an outer circumferential surface of an electric wire portion of the terminal-equipped electric wire inserted through the one of the plurality of electric wire insertion holes, and wherein a thinned groove of the plurality of thinned grooves is formed from both the front and back surfaces in the elastic seal member and an excess portion corresponding to at least two rows of the lip ring is left between the front surface and the back surface in the elastic seal member in the thickness direction.

7. The elastic seal member according to claim 6, wherein each of the plurality of electric wire insertion holes has a small diameter portion having a small inner diameter and a large diameter portion having a large inner diameter, the at least two electric wire insertion holes of the plurality of electric wire insertion holes which are provided adjacent to each other without having a thinned groove of the plurality of thinned grooved interposed therebetween are provided with a predetermined distance between their respective large diameter portions, and the circular range has a diameter equal to or larger than a length obtained by adding the predetermined distance to the inner diameter of a large diameter portion.

8. A connector, comprising:

a tubular connector housing; and an elastic seal member configured to be fitted into an opening on one end side of the connector housing, wherein the elastic seal member is the one according to claim 1.

9. The elastic seal member according to claim 1, wherein each of the electric wire insertion holes has a small diameter portion having a small inner diameter and a large diameter portion having a large inner diameter, the at least two electric wire insertion holes of the plurality of electric wire insertion holes which are provided adjacent to each other without having a thinned groove of the plurality of thinned grooved interposed therebetween are provided with a predetermined distance between their respective large diameter portions, and the circular range has a diameter equal to or larger than a length obtained by adding the predetermined distance to the inner diameter of a large diameter portion.

10. An elastic seal member formed of an elastic material in a plate shape and configured to be fitted into an opening on one end side of a tubular connector housing, the elastic seal member comprising;

a plurality of electric wire insertion holes arranged in a first direction and a second direction orthogonal to the first direction, the plurality of electric wire insertion holes being configured to have a terminal-equipped electric wire inserted therein in a thickness direction, and a plurality of thinned grooves, wherein a first thinned groove of the plurality of thinned grooves is provided adjacent to an electric wire insertion hole of the plurality of electric wire insertion holes on at least one of front and back surfaces of the elastic seal member, wherein the first thinned groove being formed into a shape that does not overlap with any of each of a circular range centered on respective ones of the plurality of electric wire insertion holes in a plan view, the respective circular ranges of juxtaposed respective ones of the plurality of electric wire insertion holes interposing the first thinned groove while not overlapping with each other, each of the plurality of electric wire insertion holes has a small diameter portion having a small inner diameter and a large diameter portion having a large inner diameter, two electric wire insertion holes of adjacent ones of the plurality of electric wire insertion holes are provided adjacent to each other without having the first thinned groove interposed therebetween, are provided with a predetermined distance between their respective large diameter portions, and have their respective circular ranges overlapping in the first direction, the circular range has a diameter equal to or larger than a length obtained by adding the predetermined distance to the inner diameter of a large diameter portion, and each of the plurality of thinned grooves is provided between the plurality of electric wire insertion holes and the plurality of thinned grooves is formed in a plurality of types of shapes in the plan view.

* * * * *